US007652413B2

(12) United States Patent
Kawashima

(10) Patent No.: US 7,652,413 B2
(45) Date of Patent: Jan. 26, 2010

(54) SPARK PLUG FOR INTERNAL COMBUSTION ENGINE

(75) Inventor: Yasushi Kawashima, Mie-ken (JP)

(73) Assignee: DENSO CORPORATION, Kariya (JP)

( * ) Notice: Subject to any disclaimer, the term of this patent is extended or adjusted under 35 U.S.C. 154(b) by 298 days.

(21) Appl. No.: 11/907,447

(22) Filed: Oct. 12, 2007

(65) Prior Publication Data

US 2008/0093964 A1 Apr. 24, 2008

(30) Foreign Application Priority Data

Oct. 18, 2006 (JP) ..... 2006-283484
May 14, 2007 (JP) ..... 2007-127662

(51) Int. Cl.
*H01T 13/20* (2006.01)
*F02B 19/00* (2006.01)

(52) U.S. Cl. ..... 313/141; 313/143; 123/260

(58) Field of Classification Search ..... 313/118, 313/141, 143, 238; 123/169 R, 260
See application file for complete search history.

(56) References Cited

U.S. PATENT DOCUMENTS 4,514,656 A * 4/1985 Damson et al. ..... 313/11.5
4,841,925 A * 6/1989 Ward ..... 313/141
5,463,267 A * 10/1995 Conway ..... 313/141
5,873,338 A * 2/1999 Matsubara et al. ..... 313/141
6,414,420 B1 * 7/2002 Suzuki ..... 313/144
6,617,769 B2 * 9/2003 Suzuki ..... 313/141
6,628,050 B1 * 9/2003 Kameda et al. ..... 313/143
7,282,844 B2 * 10/2007 Kanao et al. ..... 313/141
7,569,978 B2 * 8/2009 Tinwell ..... 313/141
2002/0149308 A1 * 10/2002 Suzuki et al. ..... 313/141
2005/0168121 A1 * 8/2005 Tinwell ..... 313/141
2009/0071429 A1 * 3/2009 Nakayama et al. ..... 123/169 R

FOREIGN PATENT DOCUMENTS

JP 2000-243535 9/2000

* cited by examiner

*Primary Examiner*—Peter Macchiarolo
(74) *Attorney, Agent, or Firm*—Nixon & Vanderhye, PC

(57) ABSTRACT

A spark plug fitted to a cylinder head has a center electrode with a noble metallic tip portion having a sectional area S1 between 0.07 $mm^2$ and 0.95 $mm^2$ and a melting point of 2000° C. or more, and a ground electrode with a noble metallic tip portion having a sectional area S2 and a melting point of 1700° C. or more. The plug has a length H ranging from 6.5 mm and 10 mm between the head and the tip portion of the center electrode, a length G ranging from 1.1 mm and 2.0 mm between the tip portions, a length J between the head and a housing, a length F satisfying $J \leqq F \leqq H-1.0$ mm between the head and an insulator, and a pocket clearance P satisfying $P \geqq 1.1 \times (G+0.0345 \times S1^{-1.2418}+0.0327 \times S2^{-1.2418})$ between the housing and the insulator.

19 Claims, 10 Drawing Sheets

SPARK PLUG FOR INTERNAL COMBUSTION ENGINE

CROSS-REFERENCE TO RELATED APPLICATION

This application is based upon and claims the benefit of priority of the prior Japanese Patent Application 2006-283484 filed on Oct. 18, 2006, and the prior Japanese Patent Application 2007-127662 filed on May 14, 2007 so that the contents of which are incorporated herein by reference.

BACKGROUND OF THE INVENTION

1. Field of the Invention

The present invention relates generally to a sparkplug disposed in an internal combustion engine, and more particularly to the spark plug having a long spark discharging gap and a firing area of electrodes largely protruded into a combustion chamber of the engine.

2. Description of Related Art

In an internal combustion engine, a cooling performance has been heightened by improving the arrangement of water jackets disposed in an engine head. Therefore, a structure of an engine head is complicated, and a space for fitting a spark plug to a cylinder head of the engine is narrowed.

In this case, it is required to lessen the diameter of a male thread of the spark plug to be engaged with a female thread of the head. However, when the diameter of the thread is lessened, a top portion of an insulator disposed on an outer circumferential surface of a center electrode is thinned so as to undesirably cause dielectric breakdown in the plug, and a pocket bore formed between the insulator and a housing connected with a ground electrode is narrowed so as to cause transverse flying sparks. In the transverse flying sparks, sparks are undesirably discharged from the center electrode to an end portion of the housing through a surface portion of the insulator.

To solve these problems, Published Japanese Patent First Publication No. 2000-243535 discloses a spark plug having an attaching screw engaged with a cylinder head. The diameter of the screw is equal to or smaller than 12 mm. In this plug, the thickness of a top portion of an insulator is set to be equal to or larger than 1.1 mm to heighten a withstand voltage of the insulator, and the diameter of a center electrode is lessened so as to widen a pocket bore for the purpose of preventing a phenomenon of transverse flying sparks.

However, when this plug disclosed in the Publication is used for a long period of time, the tips of the center and ground electrodes facing each other are melted and partially lost due to sparks discharged between the electrode tips. Therefore, a spark discharging gap between the tips is lengthened. This lengthened spark discharging gap easily induces transverse flying sparks. Therefore, although the plug having a structure disclosed in the Publication can prevent transverse flying sparks when being used for a comparatively short period of time, transverse flying sparks can easily occur in the plug when sparks are discharged between the tips of the center and ground electrodes for a long period of time so as to lose the tips of the electrodes. That is, when a spark plug is used for its original purpose for a long period of time, the plug loses its original function.

Further, low fuel economy and low emission have recently been required, so that a higher ignition performance is desired in a spark plug. To realize the higher ignition performance, an extension type spark plug having a wide spark discharging gap is required. In the extension type spark plug, the tips of the center and ground electrodes are largely protruded from a cylinder head into a combustion chamber of an engine so as to place a firing area between the tips in the center of the combustion chamber. When a wide spark discharging gap type plug has a structure disclosed in the Publication No. 2000-243535, not only the plug can easily cause transverse flying sparks, but also it is difficult to excessively protrude the chips toward the combustion chamber for the purpose of preventing the pre-ignition.

Moreover, the extension type spark plug has a long ground electrode extended from a metallic housing. When sparks are discharged between tips of center and ground electrodes, it is difficult to transfer heat received in the tip of the ground electrode to the housing. Therefore, the tip of the ground electrode is easily heated up to a high temperature, so that the tip may be undesirably melted or oxidized by a gas of the chamber.

SUMMARY OF THE INVENTION

An object of the present invention is to provide, with due consideration to the drawbacks of the conventional spark plug, a spark plug which stably discharges sparks between tip portions of electrodes at a high ignition performance for a long period of time without causing transverse flying sparks or reducing the tip portions.

According to a first aspect of this invention, the object is achieved by the provision of a spark plug comprising a center electrode, an insulator disposed on an outer circumferential surface of the center electrode so as to have an end portion protruded from an end surface of a cylinder head of an internal combustion engine into a combustion chamber of the engine facing the end surface of the cylinder head, a metallic housing disposed on an outer circumferential surface of the insulator and fixed to the cylinder head so as to have an end portion facing the combustion chamber, a ground electrode attached to the housing, a tip portion disposed on the center electrode so as to be placed in the combustion chamber, and another tip portion disposed on the ground electrode to form a spark discharging gap between the tip portions. A pocket bore is formed between the insulator and the housing so as to face the combustion chamber. A spark position length H between the end surface of the cylinder head and the tip portion of the center electrode is set within a range from 6.5 mm to 10 mm. A spark discharging gap length G between the tip portions is set within a range from 1.1 mm to 2.0 mm. A housing position length J between the end surface of the cylinder head and the end portion of the housing, the spark position length H and an insulator position length F between the end surface of the cylinder head and the end portion of the insulator are set to satisfy a relation of $J \leqq F \leqq H-1.0$ mm. A sectional area S1 of the tip portion of the center electrode on a plane perpendicular to a center axis of the center electrode is set within a range from 0.07 $mm^2$ to 0.95 $mm^2$. The tip portion of the center electrode is made of a first noble metal having a melting point equal to or higher than 2000° C. or is made of a first alloy containing the first noble metal. The tip portion of the ground electrode is made of a second noble metal having a melting point equal to or higher than 1700° C. or is made of a second alloy containing the second noble metal. The spark discharging gap length G, the sectional area S1 of the tip portion of the center electrode, a sectional area S2 of the tip portion of the ground electrode on a plane perpendicular to a center axis of the ground electrode chip, and a pocket clearance P of the pocket bore denoting a half of a difference between an inner diameter of the end portion of the housing and an outer diameter of the end portion of the insulator are set to satisfy a relation of $P \geqq 1.1 \times (G + 0.0345 \times S1^{-1.2418} + 0.0327 \times S2^{-1.2418})$ when the areas S1 and S2 are expressed in $mm^2$ while the length G and the clearance P are expressed in mm.

With this structure of the spark plug, when a voltage difference is applied between the electrodes, sparks are discharged between the electrodes, and a gas of the combustion chamber is burned to produce a driving torque in the engine.

The plug can have a high ignition performance by the structures such as the range 6.5 mm≦H, the range of 1.1 mm≦G, and the relation J≦F≦H−1.0 mm. Further, the plug can reliably prevent transverse flying sparks by the range of G≦2.0 mm and the relation of $P \geqq 1.1 \times (G + 0.0345 \times S1^{-1.2418} + 0.0327 \times S2^{-1.2418})$ even when the plug performs spark discharges for a long period of time. Moreover, the plug can reliably prevent oxidization and melting of the tip portion of the ground electrode due to the range of H≦10 mm and the ground electrode tip portion made of a noble metal having a melting point equal to or higher than 1700° C. or an alloy containing the noble metal. Furthermore, because the tip portion of the center electrode is made of a noble metal having a melting point equal to or higher than 2000° C. or an alloy containing the noble metal, the center electrode tip portion is hardly melted or lost.

Accordingly, the plug can stably discharge sparks between the tip portions of the center and ground electrodes at a high ignition performance for a long period of time without causing transverse flying sparks or reducing the tip portions.

According to a second aspect of this invention, the object is achieved by the provision of a spark plug comprising the center and ground electrodes with the tip portions, the insulator and the housing and being characterized by the spark position length H set to be equal to or smaller than 6.5 mm, the spark discharging gap length G set to be equal to or larger than 1.1 mm, and the housing position lengths J, F and H set to satisfy a relation of J≦F≦H−1.0 mm, and the sectional area of the tip portion of the center electrode set to be equal to or smaller than 0.95 $mm^2$.

With this structure of the plug, the spark plug can have a high ignition performance.

According to a third aspect of this invention, the object is achieved by the provision of a spark plug comprising the center and ground electrodes with the tip portions, the insulator and the housing and being characterized by the spark discharging gap length G set to be equal to or smaller than 2.0 mm, the sectional area S1 of the tip portion of the center electrode set to be equal to or larger than 0.07 $mm^2$, the sectional area S2 of the tip portion of the ground electrode set to be equal to or larger than 0.07 $mm^2$, and the length G, the areas S1 and S2 and the pocket clearance P set to satisfy a relation of $P \geqq 1.1 \times (G + 0.0345 \times S1^{-1.2418} + 0.0327 \times S2^{-1.2418})$ when the areas S1 and S2 are expressed in $mm^2$ while the length G and the clearance P are expressed in mm.

With this structure of the plug, transverse flying sparks can efficiently be prevented in the spark plug.

DETAILED DESCRIPTION OF THE PREFERRED EMBODIMENT

An embodiment of the present invention will now be described with reference to the accompanying drawings.

Figure 1:
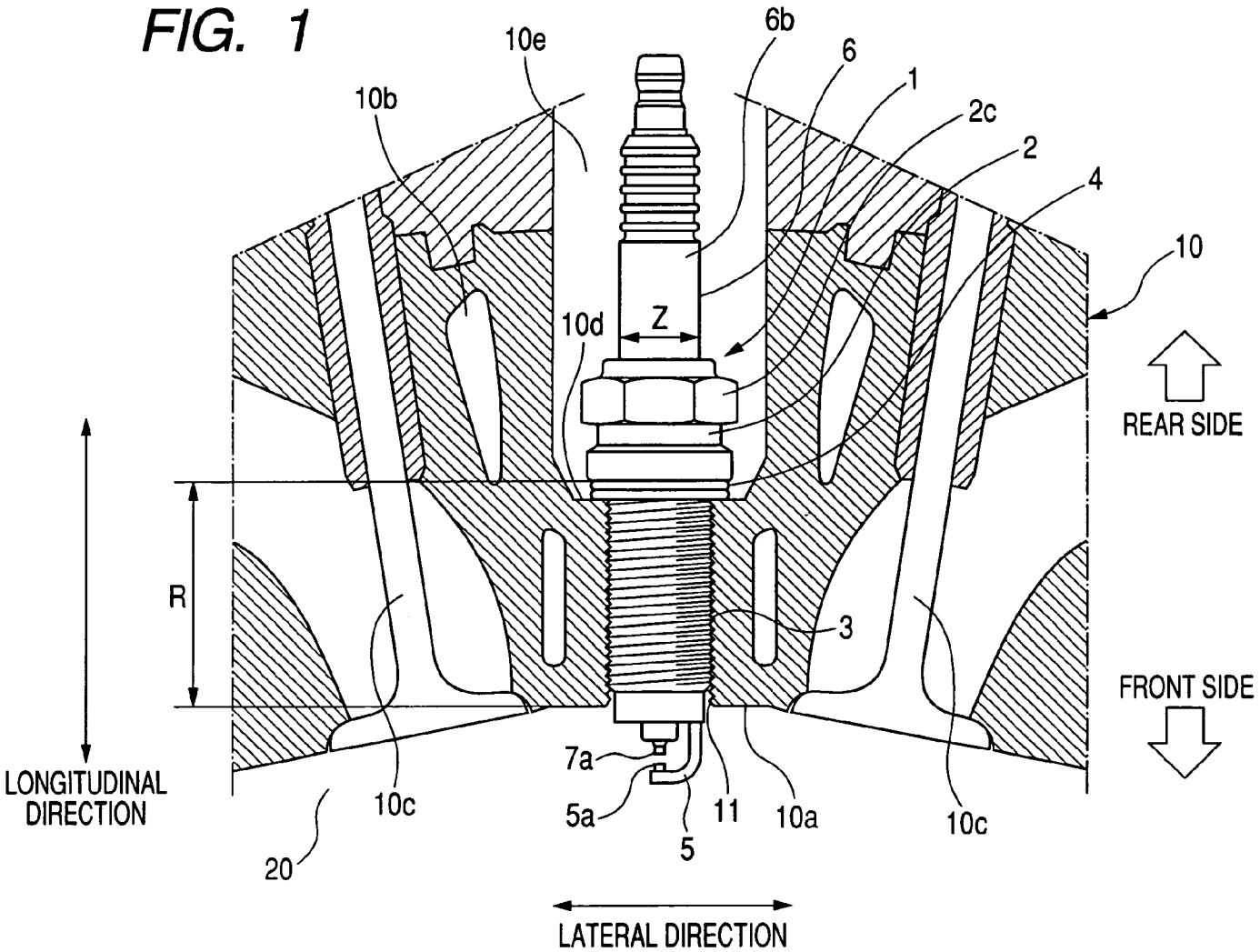
FIG. 1 is a side view of a spark plug screwed to a cylinder head of an internal combustion engine, with a sectional view of the cylinder head, according to an embodiment of the present invention.
Figure 2:
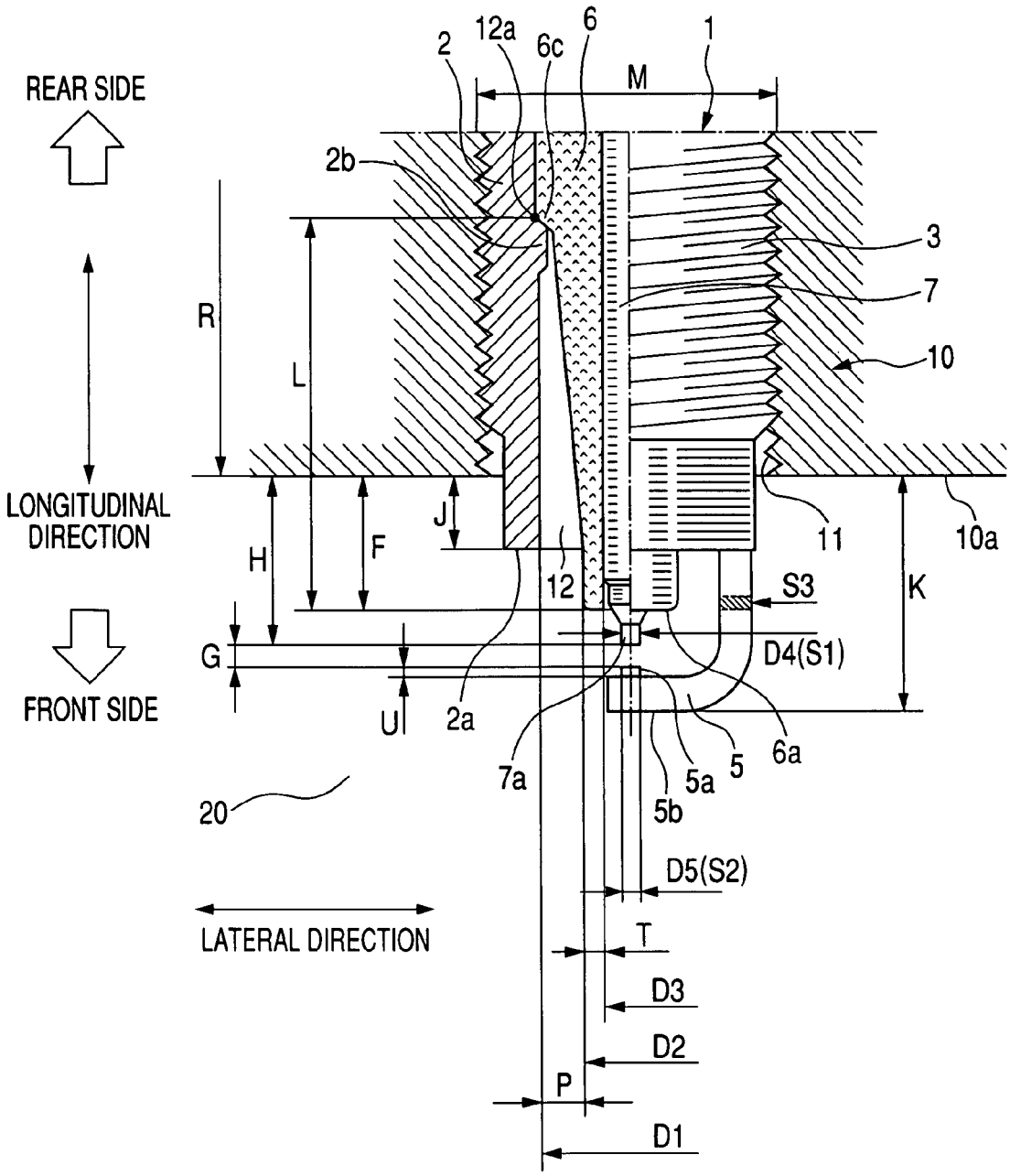
FIG. 2 is an enlarged view, partially in cross-section, of a firing area of the spark plug shown in FIG. 1.

FIG. 1 is a side view of a spark plug screwed to a cylinder head of an internal combustion engine, with a sectional view of the cylinder head, according to an embodiment of the present invention, while FIG. 2 is an enlarged view, partially in cross-section, of a firing area of the spark plug shown in FIG. 1.

As shown in FIG. 1 and FIG. 2, an internal combustion engine (not shown) has a plurality of cylinders. A head 10 of each cylinder has an inner surface 10*a* facing a combustion chamber 20 of the engine. A spark plug 1 is fitted to each head 10 so as to be extended into the chamber 20. The plug 1 has a columnar-shaped center electrode 7 having a front portion placed into the chamber 20, a cylindrical insulator 6 disposed on an outer circumferential surface of the center electrode 7, a metallic housing 2 fixedly disposed on an outer circumferential surface of the insulator 6 so as to be insulated from the center electrode 7 by the insulator 6, and a columnar-shaped ground electrode 5 attached to a front end portion of the housing 2 so as to be disposed into the chamber 20. The center electrode 7 has a tip portion 7*a* disposed on a front end thereof. The ground electrode 5 has a tip portion 5*a* disposed so as to face the tip portion 7*a*. A spark discharging gap is formed between the tip portions 5*a* and 7*a*.

The head 10 has a female thread 11 in a plug hole 10*e* thereof. The housing 2 has a male thread 3 formed on an outer circumferential surface thereof on a front side of the housing 2. The male thread 3 of the housing 2 is engaged with the female thread 11 of the head 10 to fixedly fit the spark plug 1 to the head 10.

Within the head 10, water jackets 10*b* are disposed with intake and exhaust valves 10*c*. Water passes through the jackets 10*b* to cool the head 10 and the plug 1. The plug 1 is placed between the valves 10*c*. The valves 10*c* are opened and closed to intake an air into the combustion chamber 20 and to exhaust a combustion gas from the chamber 20. Recently, it has been required to further improve the performance of the engine, so that the structure of the head 10 has been complicated. For example, the jackets 10*b* are placed near the plug 1 to efficiently cool the plug 1, and an angle between the intake and exhaust valves 10*c* is narrowed to efficiently burn the fuel gas in the chamber 10. This complicated structure of the head 10 narrows an arranging space of the plug 1 fitted to the head 10.

The housing 2 is formed almost in a cylindrical shape. The housing 2 has an annular front end face 2*a* on a front end portion which is disposed to be protruded from the inner surface 10*a* of the head 10 into the combustion chamber 20. The insulator 6 has an annular front end face 6*a* on a front end portion which is disposed to be protruded from the surface 10*a* of the head 10 and the end face 2*a* of the housing 2 into the chamber 20. The insulator 6 has a head portion 6*b* protruded from the head 10 into the plug hole 10*e* on the rear side opposite to the chamber 20. At a contact region placed on the rear side of the plug 1 from an annular contact line 12*a*, a raised portion 2*b* of the housing 2 is fixedly fitted to a raised portion 6*c* of the insulator 6 by using a difference in thermal expansion between the insulator 6 and the housing 2. An axial pocket bore 12 closed at the contact line 12*a* is formed between the insulator 6 and the housing 2 and faces the combustion chamber 20.

The center electrode 7 covered with the insulator 6 is extended along a longitudinal direction of the plug 1, and a front portion of the electrode 7 is tapered and exposed to the chamber 20. The tip portion 7*a* of the center electrode 7 is placed on the taper portion of the electrode 7 in the combustion chamber 20. The ground electrode 5 is extended from the end face 2*a* of the housing 2 along the longitudinal direction so as to be placed into the chamber 20. The ground electrode 5 is bent in a lateral direction perpendicular to the longitudinal direction almost in an L shape such that the tip portion 5*a* of the electrode 5 faces the tip portion 7*a* of the electrode 7 along the longitudinal direction.

The tip portion 7*a* of the center electrode 7 is made of a first noble metal having a melting point equal to or higher than 2000° C. or is made of a metallic alloy containing the first noble metal. For example, the tip portion 7*a* is made of iridium (Ir) or an iridium alloy containing 50% iridium or more by weight. The tip portion 5*a* of the ground electrode 5 is made of a second noble metal having a melting point equal to or higher than 1700° C. and resistance to oxidation or is made of a metallic alloy containing the second noble metal. For example, the tip portion 5*a* is made of platinum (Pt) or a platinum alloy containing 50% platinum or more by weight. Because the tip portion 7*a* is made of a metallic material having a high melting point, the tip portion 7*a* is hardly melted or reduced due to sparks discharged between the tip portions 5*a* and 7*a*. Because the tip portion 5*a* is made of a metallic material having resistance to oxidation at a comparatively high temperature, the tip portion 5*a* is hardly oxidized in a high temperature and acid atmosphere such as a combustion gas.

The housing 2 has a hexagon tool fitting portion 2*c* with six faces on the rear side of the housing 2. The portion 2*c* is disposed on an outer circumferential surface of the head portion 6*b* of the insulator 6. A gasket 4 is attached to the housing 2 between the tool fitting portion 2*c* and the thread 3.

Figure 3:
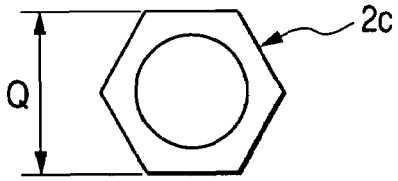
FIG. 3 is a front view of a hexagon tool fitting portion shown in FIG. 1.

FIG. 3 is a front view of the hexagon tool fitting portion 2*c* according to this embodiment. As shown in FIG. 3, to engage the male thread 3 of the housing 2 with the female thread 11 of the head 10, a fixing tool such as a plug wrench (not shown) is fitted to two faces of the tool fitting portion 2*c*. The tool fitting portion 2*c* is rotated by the fixing tool so as to place the gasket 4 between the portion 2*c* and an upper end surface 10*d* of the head 10 at a certain fitting torque. Therefore, the housing 2 is fixedly disposed in the head 10 to fit the spark plug 1 to the head 10.

With this structure of the spark plug 1, when a fuel and air are supplied to the chamber 20, a voltage difference is applied between the electrodes 5 and 7. Therefore, spark discharges occur between the tip portions 5*a* and 7*a*, and the fuel is burned so as to produce a driving torque in the engine.

Figure 4A:
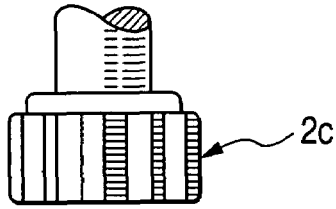
FIG. 4A is a side view of a bi-hexagon tool fitting portion according to a modification of this embodiment.
Figure 4B:
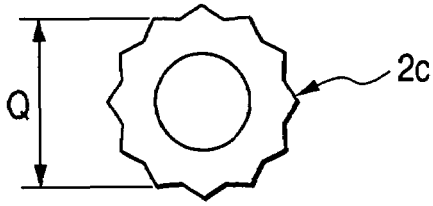
FIG. 4B is a top view of the fitting portion shown in FIG. 4A.

FIG. 4A is a side view of a bi-hexagon tool fitting portion according to a modification of this embodiment, while FIG. 4B is a top view of the bi-hexagon tool fitting portion. In place of the portion 2*c* shown in FIG. 3, a bi-hexagon tool fitting portion shown in FIG. 4A and FIG. 4B may be used for the plug 1. Because the bi-hexagon tool fitting portion with twelve faces has a wall thickness larger than that of the hexagon tool fitting portion, the bi-hexagon tool fitting portion is superior in strength. Therefore, the spark plug 1 can be fitted to the head 10 at a high fitting torque.

Next, lengths, clearance, width, diameters, thickness and sectional areas required to express the positional relation in the spark plug 1 attached to the head 10 are described with reference to FIG. 1 and FIG. 2.

A longitudinal directional distance between the inner surface 10*a* of the cylinder head 10 facing the chamber 10 and a top of the tip portion 7*a* of the center electrode 7 protruded into the chamber 10 is defined as a spark position length H.

A longitudinal directional distance between the tip portions 5*a* and 7*a* is defined as a spark discharging gap length G.

A longitudinal directional distance between the inner surface 10*a* of the head 10 and the end face 2*a* of the housing 2 is defined as a housing position length (or shroud length) J.

A longitudinal directional distance between the inner surface 10*a* of the head 10 and the end face 6*a* of the insulator 6 is defined as an insulator position length F.

Half of a difference between an inner diameter D1 of the housing 2 and an outer diameter D2 of the end face 6*a* of the insulator 6 is defined as a pocket clearance P (P=(D1−D2)/2) of the pocket bore 12.

A longitudinal directional distance between the contact line 12*a* and the end face 6*a* of the insulator 6 is defined as a leg length L.

As shown in FIG. 3 and FIG. 4B, a width between the two faces of the tool fitting portion 2*c* fitted by a fixing tool is defined as a two-face width Q.

A longitudinal directional distance between an upper surface of the gasket 4 facing an upper side surface 10*d* of the head 10 and an end of the female thread 11 of the head 10 facing the chamber 20 is defined as a fitting length R.

A longitudinal directional distance between the end surface 10*a* of the head 10 and an end surface 5*b* of the ground electrode 5 on a side opposite to the center electrode 7 is defined as a ground electrode position length K.

A diameter of the male thread 3 of the housing 2 is defined as a thread diameter M.

The head portion 6*b* of the insulator 6 has an outer diameter Z.

A longitudinal directional length of the tip portion 5*a* of the ground electrode 5 is defined as a protrusion length U of the tip portion 5*a*.

An area of the tip portion 7*a* of the center electrode 7 on a plane perpendicular to the longitudinal direction (i.e., a center axis of the center electrode chip 7*a*) is defined as a sectional area S1.

An area of the tip portion 5*a* of the ground electrode 5 on a plane perpendicular to the longitudinal direction (i.e., a center axis of the ground electrode chip 5*a*) is defined as a sectional area S2.

An area of the ground electrode 5 on a plane perpendicular to an extending direction of the ground electrode 5 is defined as a sectional area S3.

The inner diameter D1 of the housing 2 is defined.

The outer diameter D2 of the end face 6*a* of the insulator 6 is defined.

An outer diameter D3 of the center electrode 7 is defined.

An outer diameter D4 of the tip portion 7*a* of the center electrode 7 is defined.

An outer diameter D5 of the tip portion 5*a* of the ground electrode 5 is defined.

A wall thickness T of the end portion 6*a* of the insulator 6 is defined.

These lengths H, G, J, F, R, K and U, the clearance P, the width Q, the diameters D1 to D5, and the thickness T are expressed in mm. The areas S1 to S3 are expressed in $mm^2$.

Next, the positional relation in the spark plug 1 is described based on experimental results shown in FIG. 5 to FIG. 16. These results are obtained by discharging sparks in samples of the spark plug 1.

Figure 5:
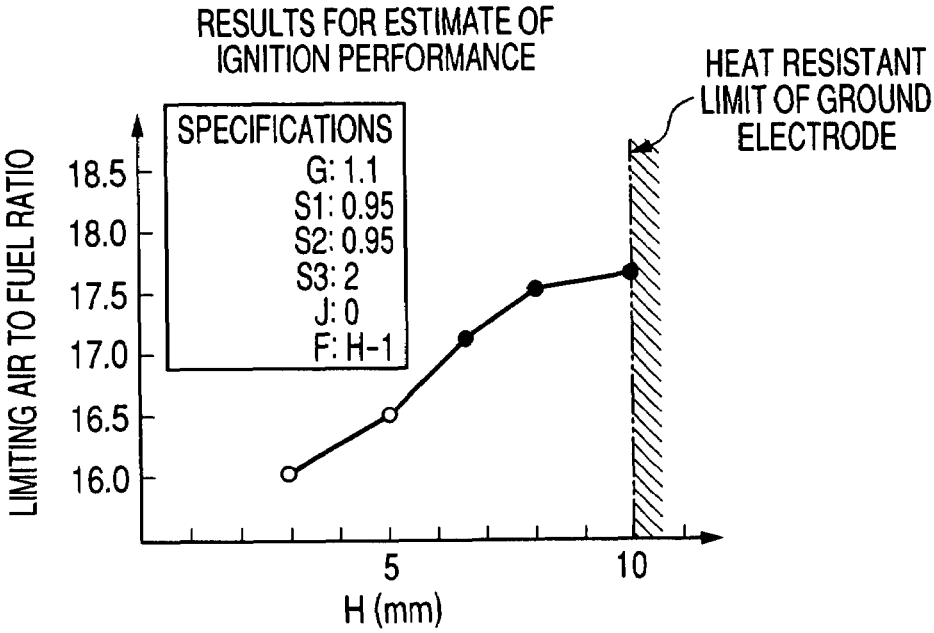
FIG. 5 is a graphic view showing a change of a limiting air to fuel ratio with respect to a spark position length in the plug shown in FIG. 2.

FIG. 5 is a graphic view showing a change of a limiting air to fuel ratio with respect to the spark position length H in the plug 1. An ignition performance of the plug 1 is estimated based on a limiting air to fuel ratio with reference to FIG. 5. To obtain experimental results shown in FIG. 5, an internal combustion engine with six cylinders and displacement of 2000 cc was driven at 600 rpm (revolutions per minute) in an idling operation. In the plug 1, the spark discharging gap length G is set at 1.1 mm, the sectional area S1 is set at 0.95 $mm^2$, the sectional area S2 is set at 0.95 $mm^2$, the sectional area S3 is set at 2 $mm^2$, the housing position length J is set at zero, and the insulator position length F and the spark position length H are set to satisfy a relation of F=H−1 mm. As described later, the length G set at 1.1 mm gives to the plug 1 the most severe condition for the ignition performance.

As shown in FIG. 5, when the length H is smaller than 6.5 mm, a limiting air to fuel ratio is smaller than 17.0. Therefore, the ignition performance of the plug 1 is considerably degraded. In contrast, when the length H exceeds 10 mm, the ground electrode 5 is lengthened so as to degrade a heat transfer performance. Therefore, when the electrode 5 receives heat from sparks, the electrode 5 is heated at a high temperature and may be easily broken, oxidized or melted.

Accordingly, when the length H is set within a range from 6.5 mm to 10 mm (6.5 mm≦H≦10 mm), the plug 1 can have a high ignition performance, and the electrode 5 is hardly broken, oxidized or melted.

Figure 6:
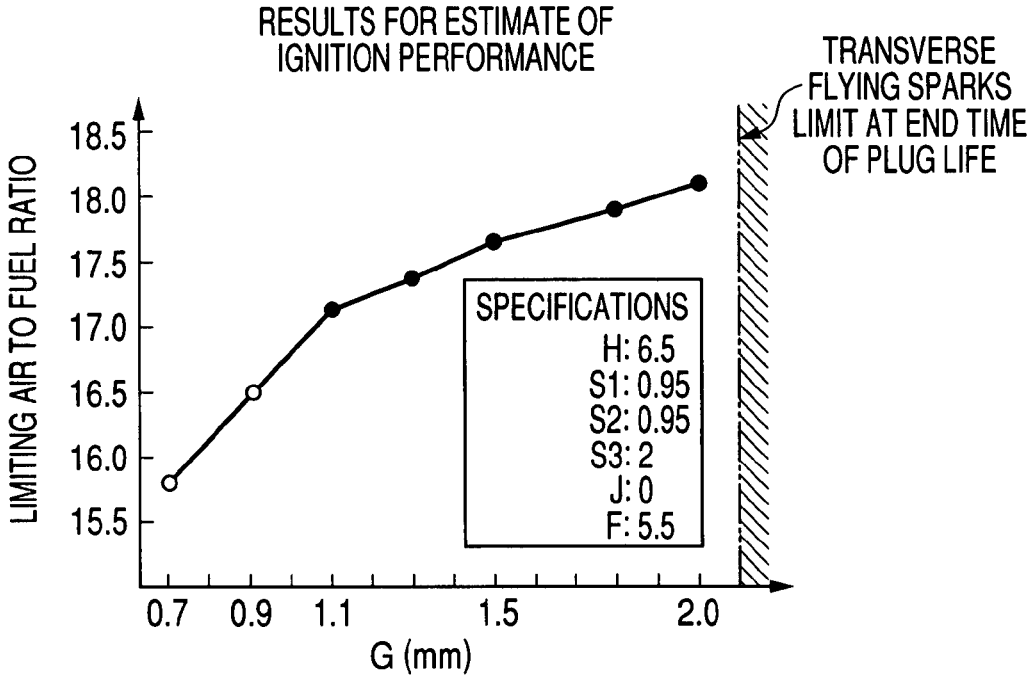
FIG. 6 is a graphic view showing a change of a limiting air to fuel ratio with respect to a spark discharging gap length in the plug shown in FIG. 2.

FIG. 6 is a graphic view showing a change of a limiting air to fuel ratio with respect to the spark discharging gap length G in the plug 1. An ignition performance of the plug 1 is estimated with reference to FIG. 6. Experimental results shown in FIG. 6 were obtained in the same conditions as the results shown in FIG. 5 were obtained. The spark position length H set at 6.5 mm puts the plug 1 in the most severe condition for the ignition performance. The insulator position length F is set at 5.5 mm. The areas S1 to S3 and the length J are set in the same manner as those shown in FIG. 5.

As shown in FIG. 6, when the length G is smaller than 1.1 mm, the limiting air to fuel ratio becomes smaller than 17.0. Therefore, the ignition performance of the plug 1 is considerably degraded. In contrast, when the length G exceeds 2.0 mm, the plug 1 exceeds a transverse flying sparks limit at an end time of the plug life. That is, when the plug 1 is used for a long period of time, the length G is excessively lengthened due to the reduction of the tip portions 5*a* and 7*a*, and transverse flying sparks may easily occur in the plug 1.

Accordingly, when the length G is set within a range from 1.1 mm to 2.0 mm (1.1 mm≦G≦2.0 mm), the plug 1 can have a high ignition performance, and transverse flying sparks hardly occur in the plug 1.

When the length G is set within a range from 1.3 mm to 2.0 mm (1.3 mm≦G≦2.0 mm), the air to fuel ratio exceeds a value of 17.4. Therefore, the plug 1 can have an excellent ignition performance.

Figure 7:
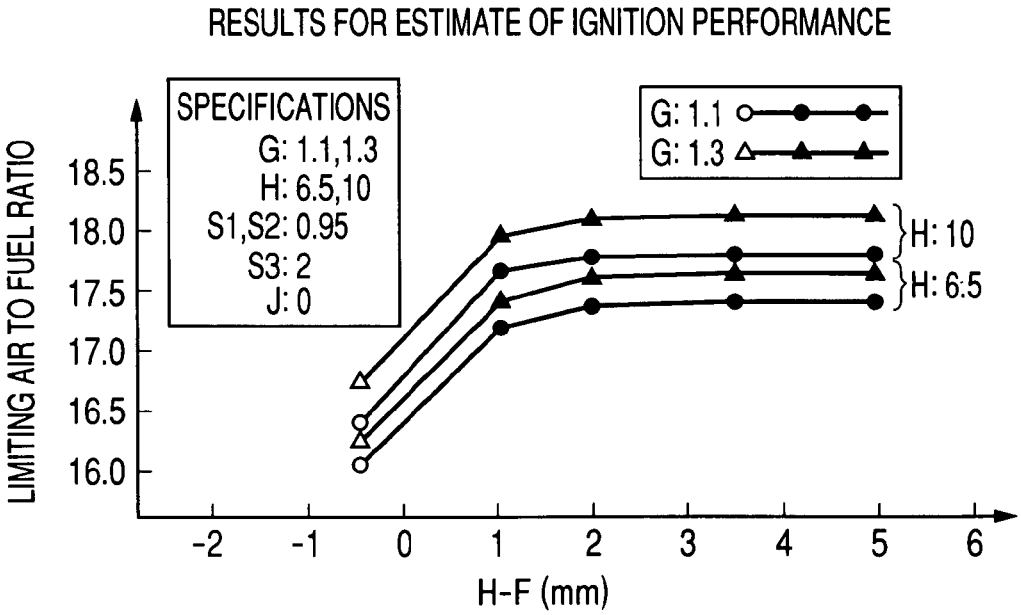
FIG. 7 is a graphic view showing a change of a limiting air to fuel ratio with respect to a difference between a spark position length and an insulator position length in the plug shown in FIG. 2.

FIG. 7 is a graphic view showing a change of a limiting air to fuel ratio with respect to a difference between the spark position length H and the insulator position length F in the plug 1. An ignition performance of the plug 1 is estimated with reference to FIG. 7. Experimental results shown in FIG. 7 were obtained in the same conditions as the results shown in FIG. 6 were obtained. The spark discharging gap length G is set at 1.1 mm to put some samples of the plug 1 in the most severe condition for the ignition performance. The length G is also set at 1.3 mm for other samples of the plug 1. The spark position length H is set at the low limit value of 6.5 mm for some samples of the plug 1 and is set at the high limit value of 10.0 mm for other samples of the plug 1. The areas S1 to S3 and the length J are set in the same manner as those shown in FIG. 6.

As shown in FIG. 7, when the difference H−F is smaller than 11.0 mm, the limiting air to fuel ratio becomes extraordinarily smaller than 17.0 so as to considerably degrade the ignition performance of the plug 1. Therefore, the difference H−F should be equal to or larger than 11.0 mm (11.0 mm≦H−F) to obtain a high ignition performance. As compared with the length G set at 1.1 mm, the length G set at 1.3 mm heightens the limiting air to fuel ratio so as to improve the ignition performance of the plug 1.

Further, other experimental results (not shown) teach that, when the length F is smaller than the length J, the ignition performance is considerably degraded. Therefore, the length F should be equal to or larger than the length J (J≦F) to maintain a high ignition performance.

Accordingly, when the lengths J, F and H satisfy a relation of J≦F≦H−1.0 mm, the plug 1 can have a high ignition performance.

Moreover, still other experimental results (not shown) teach that, when the sectional area S1 of the tip portion 7*a* of the center electrode 7 is smaller than 0.07 $mm^2$, the temperature of the tip portion 7*a* is considerably heightened. Therefore, the tip portion 7*a* is easily melted and reduced. In contrast, when the sectional area S1 of the tip portion 7*a* of the center electrode 7 exceeds 0.95 $mm^2$, flame kernels generated on the tip portion 7*a* during spark discharges easily disappear because the heat of the kernels is transferred to the wide tip portion 7*a*. Therefore, the ignition performance of the plug 1 is degraded.

Accordingly, when the sectional area S1 is set within a range from 0.07 $mm^2$ to 0.95 $mm^2$ (0.07 $mm^2 \leqq S1 \leqq 0.95$ $mm^2$) in other words, when the diameter D4 of the tip portion 7*a* satisfies a relation of 0.3 mm≦D4≦1.1 mm), the plug 1 can have a high ignition performance, and the tip portion 7*a* is hardly reduced.

Each of the tip portions 5*a* and 7*a* should be made of a material having a high melting point. The center electrode 7 is used as a negative electrode, so that the tip portion 7*a* reaches a temperature higher than that of the tip portion 5*a*. To prevent the tip portion 7*a* from being largely reduced by sparks discharged between the electrodes 5 and 7, a melting point of the tip portion 7*a* is set to be higher than that of the tip portion 5*a*. The tip portion 7*a* is preferably made of a noble metal (e.g., indium) having a melting point equal to or higher than 2000° C. or an alloy containing the metal. The tip portion 5*a* is preferably made of a noble metal e.g., platinum) having a melting point equal to or higher than 1700° C. or an alloy containing the metal.

The pocket clearance P should be set such that the occurrence of transverse flying sparks is suppressed even when the plug 1 is used for a long period of time. In other words, the pocket clearance P should be set while considering a change of the spark discharging gap length G caused based on the reduction of the tip portions 5*a* and 7*a*.

Figure 8A:
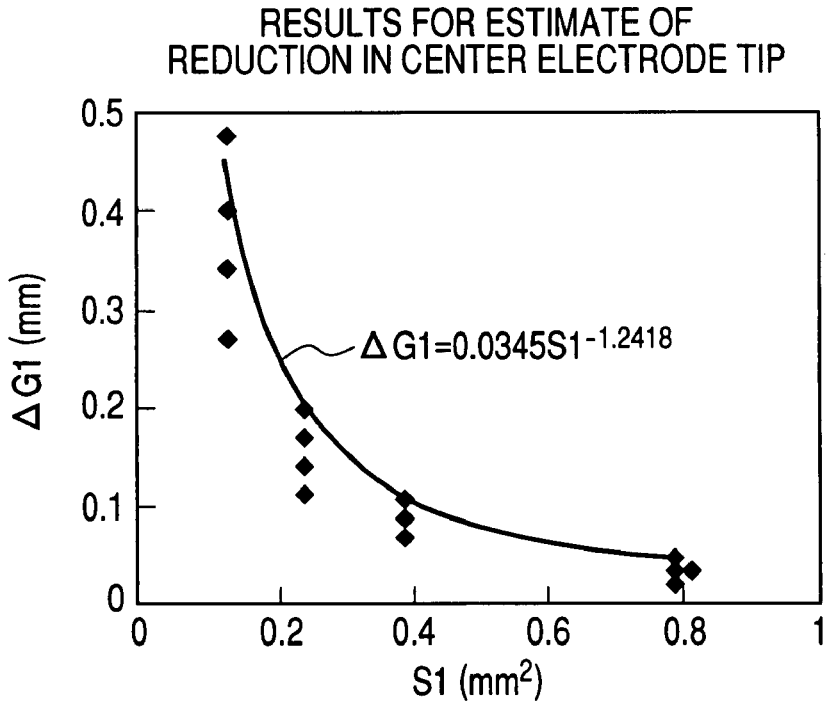
FIG. 8A is a graphic view showing a change in thickness of a tip portion of a center electrode tip with respect to a sectional area of the tip portion in the plug shown in FIG. 2.
Figure 8B:
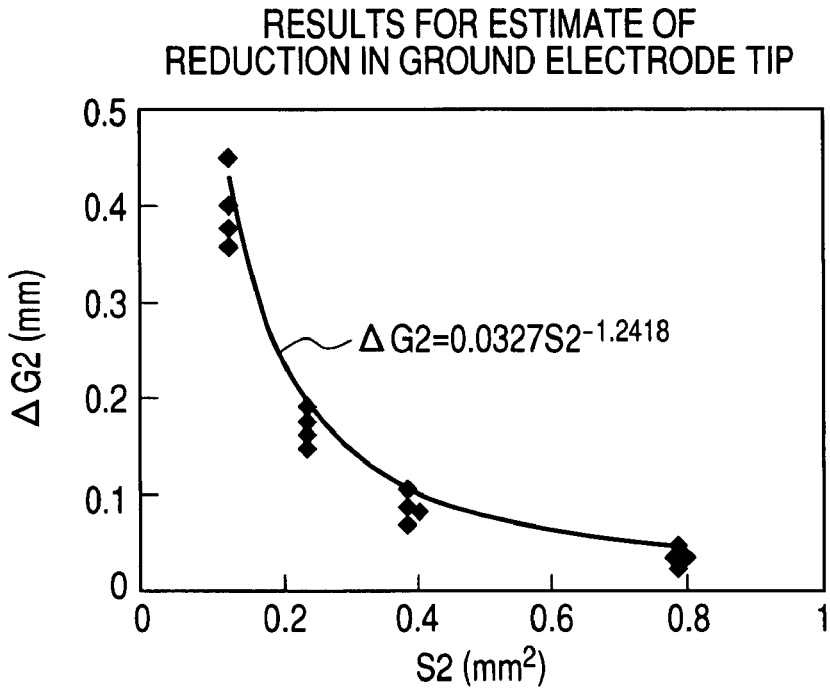
FIG. 8B is a graphic view showing a change in thickness of a tip portion of a ground electrode with respect to a sectional area of the tip in the plug shown in FIG. 2.

FIG. 8A is a graphic view showing a change ΔG1 in the thickness of the tip portion 7*a* of the center electrode 7 with respect to the sectional area S1 of the tip portion 7*a*, while FIG. 8B is a graphic view showing a change ΔG2 in the thickness of the tip portion 5*a* of the ground electrode 5 with respect to the sectional area S2 of the tip portion 5*a*. An increase of the length G caused based on the reduction of the tip portion 7*a* is estimated with reference to FIG. 8A, and an increase of the length G caused based on the reduction of the tip portion 5*a* is estimated with reference to FIG. 8B. After the vehicle was run by 105,000 miles (almost 169,000 km) while using the plug 1, the experimental results shown in FIG. 8A were obtained from samples of the tip portion 7*a* made of four different materials having melting points equal to or higher than 2000° C., respectively. In the same manner, the experimental results shown in FIG. 8B were obtained from samples of the tip portion 5*a* made of four different materials having melting point sequel to or higher than 1700° C., respectively.

A solid line shown in FIG. 8A is drawn so as to pass through experimental results obtained from samples of the tip portion 7*a* having the melting point equal to 2000° C. A solid line shown in FIG. 8B is drawn so as to pass through experimental results obtained from samples of the tip portion 5*a* having the melting point equal to 1700° C. In other words, a solid line shown in FIG. 8A indicates a change in the tip portion 7*a* reduced most, and a solid line shown in FIG. 8B indicates a change in the tip portion 5*a* reduced most.

As shown in FIG. 8A and FIG. 8B, a change ΔG1 in the thickness of the tip portion 7*a* and the area S1 satisfy a relation of $\Delta G1\ (mm) = 0.0345 \times S1^{-1.2418}$, and a change ΔG2 in the thickness of the tip portion 5*a* and the area S2 satisfy a relation of $\Delta G2\ (mm) = 0.0327 \times S2^{-1.2418}$. Therefore, an increase ΔG in the spark discharging gap length G satisfies a relation of $$\Delta G\ (mm) = \Delta G1 + \Delta G2 = 0.0345 \times S1^{-1.2418} + 0.0327 \times S2^{-1.2418}.$$

Therefore, a spark discharging gap length G+ΔG increased by the running of 105000 miles is determined.

Figure 9:
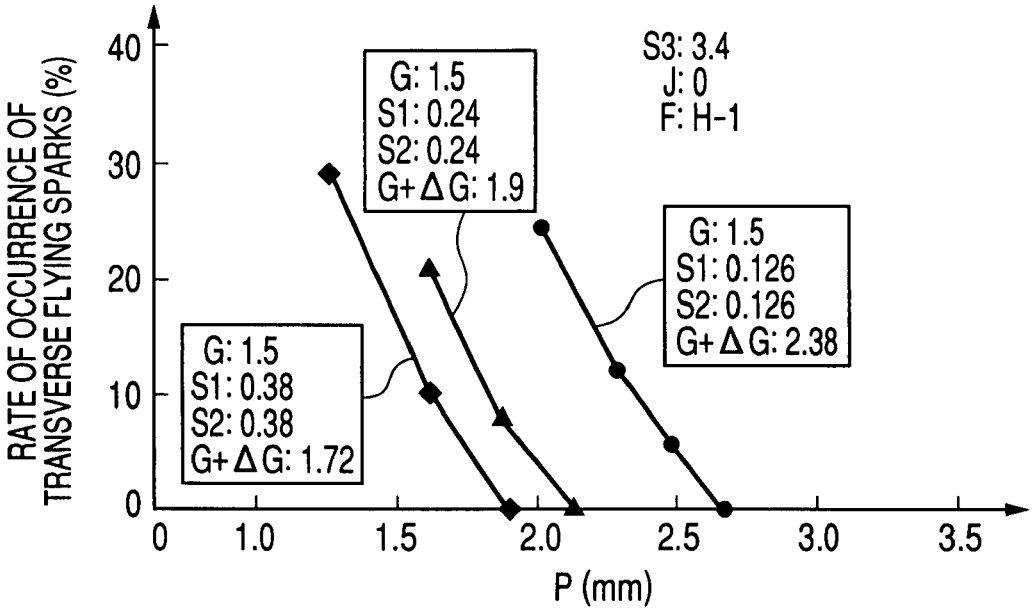
FIG. 9 is a graphic view showing a change in a rate of occurrence of transverse flying sparks with respect to a pocket clearance in the plug shown in FIG. 2.

FIG. 9 is a graphic view showing a change in a rate of occurrence of transverse flying sparks with respect to the pocket clearance P. Experimental results shown in FIG. 9 were obtained by using the increased spark discharging gap length G+ΔG as a parameter. An engine having four cylinders and displacement of 2000 cc was driven in a condition of a wide open throttle (WOT) and at an engine speed of 1000 rpm. In the plug 1, the sectional area S3 of the ground electrode 5 is set at 3.4 $mm^2$, the length J is set at 0 mm, and the lengths F and H is set to satisfy a relation of F=H−1.0 mm. In case of G=1.5 mm and S1=S2=0.38 $mm^2$, G+ΔG=1.72 mm is obtained. In case of G=1.5 mm and S1=S2=0.24 $mm^2$, G+ΔG=1.90 mm is obtained. In case of G=1.5 mm and S1=S2=0.126 $mm^2$, G+ΔG=2.38 mm is obtained.

As shown in FIG. 9, as the pocket clearance P is increased, a rate of occurrence of transverse flying sparks is decreased. When the pocket clearance P is set to be equal to or larger than 1.1×(G+ΔG), the rate of occurrence reaches zero, and the occurrence of transverse flying sparks can substantially or perfectly be suppressed.

Accordingly, when the clearance P, the length G and the areas S1 and S2 are set to satisfy a relation of $$P \geqq 1.1 \times (G + 0.0345 \times S1^{-1.2418} + 0.0327 \times S2^{-1.2418}),$$

The occurrence of transverse flying sparks can substantially be prevented in the plug 1.

For example, because G+ΔG is equal to 2.38 mm in case of G=1.5 mm and S1=S2=0.126 $mm^2$ (see line passing through black circles), the clearance P equal to or larger than 2.62 mm (=1.1×2.38) is required to prevent the occurrence of transverse flying sparks.

Based on other experimental results, it was found that, when the end portion 6*a* of the insulator 6 has the thickness T smaller than 0.3 mm, the insulator 6 would secure no resistance to the voltage of the center electrode 7. In contrast, when the thickness T is larger than 1.0 mm, heat capacity of the end portion 6*a* of the insulator 6 is increased. In this case, the end portion 6*a* of the insulator 6 may be still maintained at a high temperature after the spark discharges, so that pre-ignition is easily caused. Accordingly, it is preferred that a thickness T of the end portion 6*a* of the insulator 6 be set within a range from 0.3 mm to 1.0 mm (0.3 mm≦T≦1.0 mm).

Figure 10:
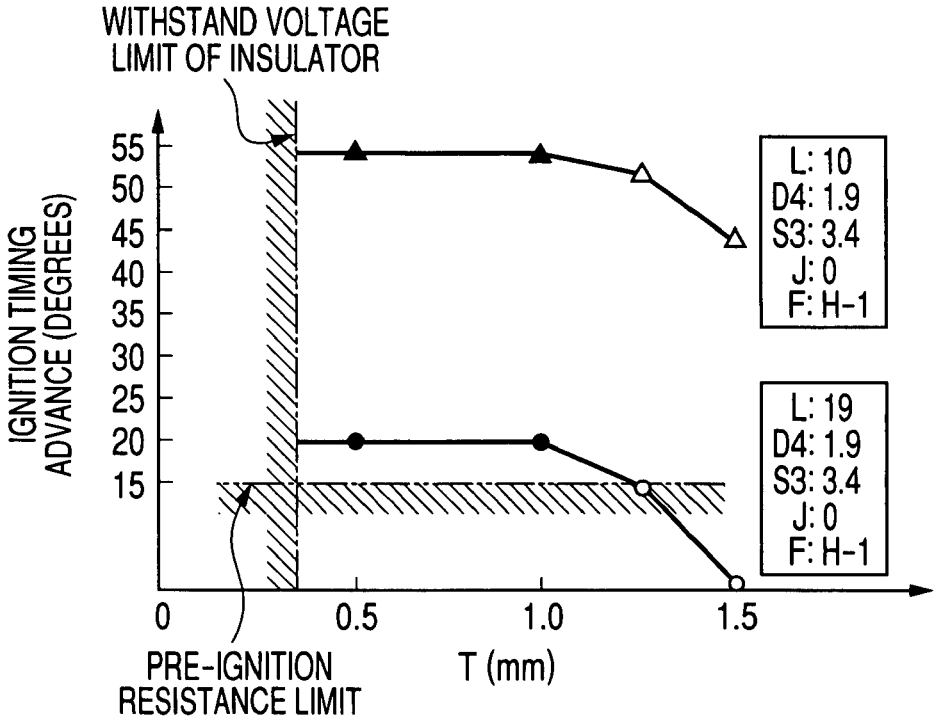
FIG. 10 is a graphic view showing a change of ignition timing advance with respect to a thickness of a front end portion of an insulator in the plug shown in FIG. 2.

A preferable range of the leg length L is described with reference to FIG. 10 and FIG. 11. FIG. 10 is a graphic view showing a change of ignition timing advance with respect to the thickness T of the end portion 6*a* of the insulator 6. Experimental results shown in FIG. 10 were obtained in case of D4=1.9 mm, S3=3.4 mm, J=0 mm and F=H−1.0 mm, and the leg length L is changed as a parameter.

As shown in FIG. 10, as the length L is increased, the ignition timing advance is decreased so as to easily cause pre-ignition in the plug 1. When the length L is larger than 19 mm, the ignition timing advance easily becomes smaller than 15 degrees. Therefore, it is difficult to prevent pre-ignition in the plug 1. Accordingly, it is preferred that the length L be equal to or smaller than 19 mm.

Figure 11:
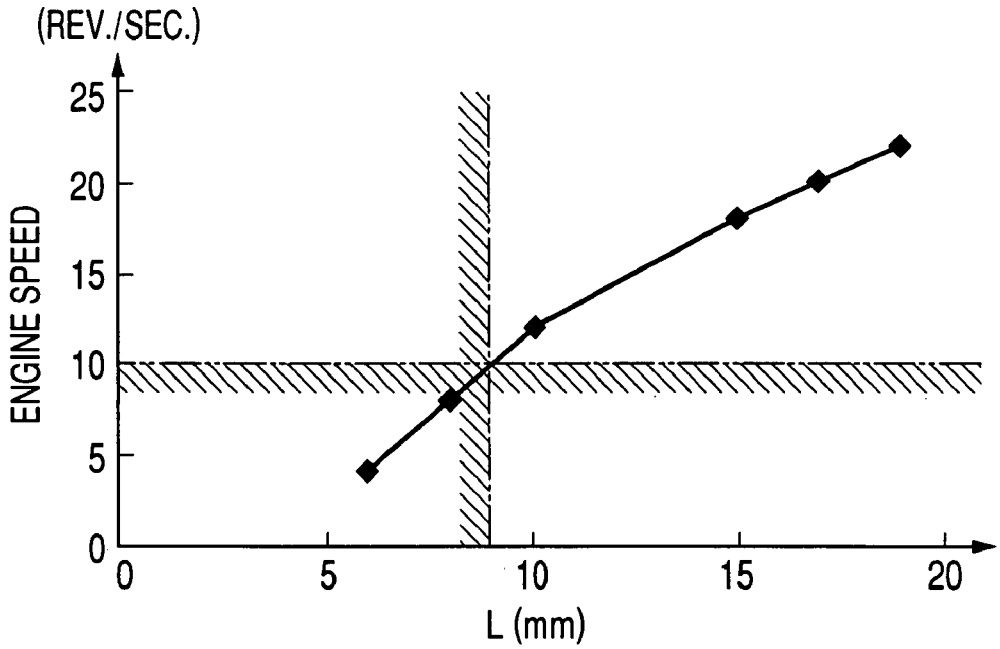
FIG. 11 is a graphic view showing a change in an engine speed with respect to a leg length in the plug shown in FIG. 2.

FIG. 11 is a graphic view showing a change in an engine speed causing the resistance of the insulator 6 to be equal to or smaller than 10 MΩ with respect to the leg length L. Experimental results shown in FIG. 11 were obtained based on a smolder fouling test in JIS (Japanese Industrial Standard) D1606 5.2 low load adaptability test (1) by driving an engine with four cylinders and displacement of 2000 cc.

As shown in FIG. 11, when the length L is smaller than 10 mm, the plug 1 cannot maintain excellent resistance to smolder fouling. Therefore, it is preferred that the length L be equal to or larger than 10 mm. Accordingly, when the preferable ranges of the length L are combined, it is preferred that the length L be set within a range from 10 mm to 19 mm (10 mm≦L≦19 mm).

Figure 12:
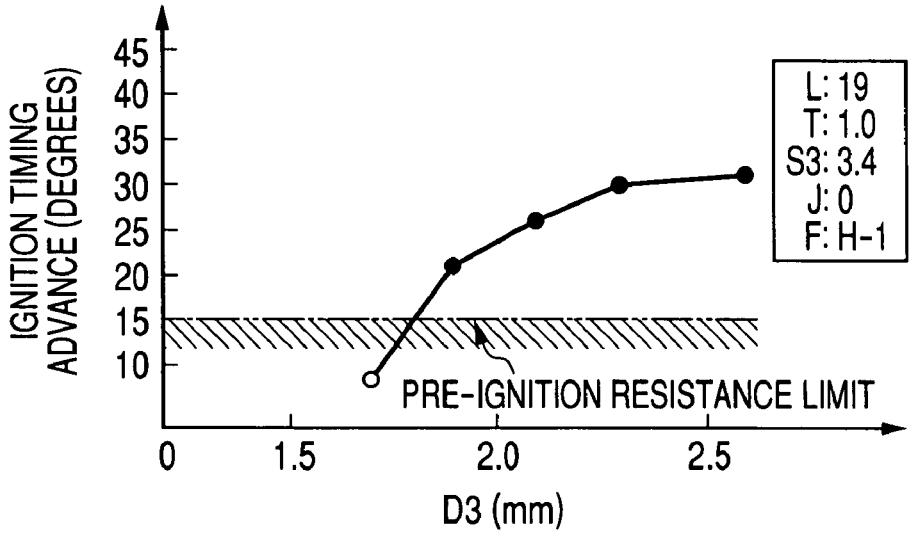
FIG. 12 is a graphic view showing a change of ignition timing advance with respect to a diameter of a center electrode in the plug shown in FIG. 2.

FIG. 12 is a graphic view showing a change of ignition timing advance with respect to the diameter D3 of the center electrode 7. Experimental results shown in FIG. 12 were obtained in case of L=19 mm, T=1.0 mm, S3=3.4 $mm^2$, J=0 mm and F=H−1.0 mm.

As shown in FIG. 12, as the diameter D3 is decreased, the ignition timing advance is decreased so as to easily cause pre-ignition in the plug 1. When the diameter D3 is smaller than 1.9 mm, the ignition timing advance becomes smaller than 15 degrees. Therefore, it is difficult to secure resistance to pre-ignition in the plug 1. Accordingly, to secure resistance to pre-ignition, it is preferred that the diameter D3 be equal to or larger than 1.9 mm.

In contrast, when the diameter D3 exceeds 2.8 mm, an outer diameter of the insulator 6 becomes large excessively. Because the inner diameter D1 of the housing 2 is determined in advance, it is difficult to set the pocket clearance P so as to prevent the occurrence of transverse flying sparks.

Accordingly, it is preferred that the center electrode 7 has the diameter D3 set within a range from 1.9 mm to 2.8 mm (1.9 mm≦D3≦2.8 mm).

For example, in case of M=12 mm, the diameter D3 is preferably set to be equal to or smaller than 2.5 mm. In case of M=10 mm, the diameter D3 is preferably set to be equal to or smaller than 2.3 mm. To secure resistance to voltage in the insulator 6, the insulator 6 should be made of a material having a resistance of 30 kV/mm to voltage.

Because a small-sized engine is required, the diameter D3 of the mail thread 3 of the housing 2 is preferably set to be equal to or smaller than 12 mm. In case of M≦8 mm, heat capacity of the housing 2 may be insufficient to receive heat from the electrode 5, and it is difficult to suppress the occurrence of transverse flying sparks. Accordingly, it is preferred that the diameter D3 of the mail thread 3 be set within a range from 8 mm to 12 mm (8 mm≦M≦12 mm).

A range of the fitting length R is described. It is required to secure a space for the water jackets 10*b* in the head 10. Further, it is required to narrow an angle between the intake and exhaust valves 10*c*. These requirements lengthen the fitting length R. The fitting length R is preferably set to be equal to or larger than 25 mm. However, as the insulator 6 is lengthened with the head 10 along the longitudinal direction, the insulator 6 becomes easily bent when the insulator 6 is processed to fit to the electrode 7. To reliably process the insulator 6, the fitting length R is preferably set to be equal to or smaller than 35 mm. Accordingly, it is preferred that the fitting length R be set within a range from 25 mm to 35 mm (25 mm≦R≦35 mm).

A range of the two-face width Q shown in FIG. 3 or FIG. 4B is described. Because a small-sized internal combustion engine has been required, the inner diameter of the plug hole 10*e* is undesirably shortened. Therefore, the two-face width Q is preferably set to be equal to or smaller than 16 mm (Q≦16 mm). Because the bi-hexagon tool fitting portion shown in FIG. 4B is superior in strength to the hexagon tool fitting portion shown in FIG. 3, the spark plug 1 with the bi-hexagon tool fitting portion may be fitted to the head 10 at a high fitting torque.

A range of the outer diameter Z of the head portion 6*b* is described. To reliably protect the plug 1 from vibrations of the engine and/or impacts, the plug 1 should have a certain strength. Therefore, the outer diameter Z is preferably set to be equal to or larger than 7 mm (Z≧7 mm).

Figure 13:
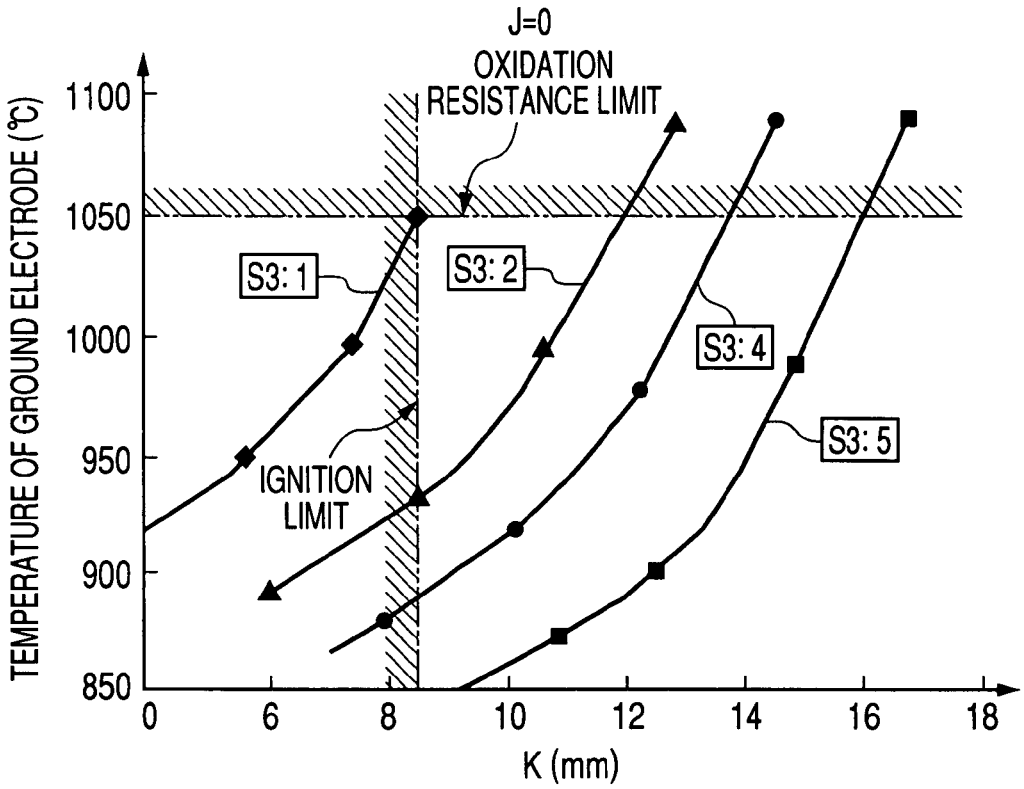
FIG. 13 is a graphic view showing a change of a temperature of a ground electrode with respect to a ground electrode length in the plug shown in FIG. 2.

A range of the sectional area S3 of the ground electrode 5 is described with reference to FIG. 13 and FIG. 14. When the ground electrode 5 is heightened to a temperature higher than an oxidation resistance limit set at 1050° C. due to sparks discharged between the electrodes 5 and 7, the electrode 5 can easily be oxidized and eroded away by a gas of the chamber 20. Further, as the ground electrode position length K is increased, the temperature of the electrode 5 is heightened. Therefore, the length K is set on condition that the temperature of the electrode 5 is reliably changed in a temperature range lower than an oxidation resistance limit set at 1050° C. FIG. 13 is a graphic view showing a change of the temperature of the electrode 5 with respect to the length K. Experimental results shown in FIG. 13 were obtained from samples of the plug 1, respectively, having the sectional area S3 of 1 $mm^2$, 2 $mm^2$, 4 $mm^2$ and 5 $mm^2$ at J=0 mm. Because of J=0 mm, the housing 2 is not projected into the chamber 20, and the end surface 2*a* of the housing 2 and the inner surface 10*a* of the head 10 are placed on the same plane.

As shown in FIG. 13, when the length K is smaller than 8.5 mm, no sparks may be discharged between the electrodes 5 and 7. To reliably discharge sparks, the length K is preferably set to be equal to or larger than an ignition limit of 8.5 mm. In case of an ignition plug having the sectional area S3≦1 $mm^2$, the electrode 5 satisfying the ignition limit (K≧8.5 mm) exceeds the oxidation resistance limit (1050° C.). Therefore, when the ignition limit is considered, the sectional area S3 is preferably set to be equal to or larger than 2 $mm^2$ (S3≧2 $mm^2$). As the area S3 is increased, the length K at the oxidation resistance limit (1050° C.) is enlarged so as to allow the ground electrode 5 to be further protruded into the chamber 20. Therefore, an upper limit of the length K is heightened as the area S3 is increased. More specifically, a relation of K=1.4×S3+9.2 mm is satisfied at the oxidation resistance limit.

Figure 14:
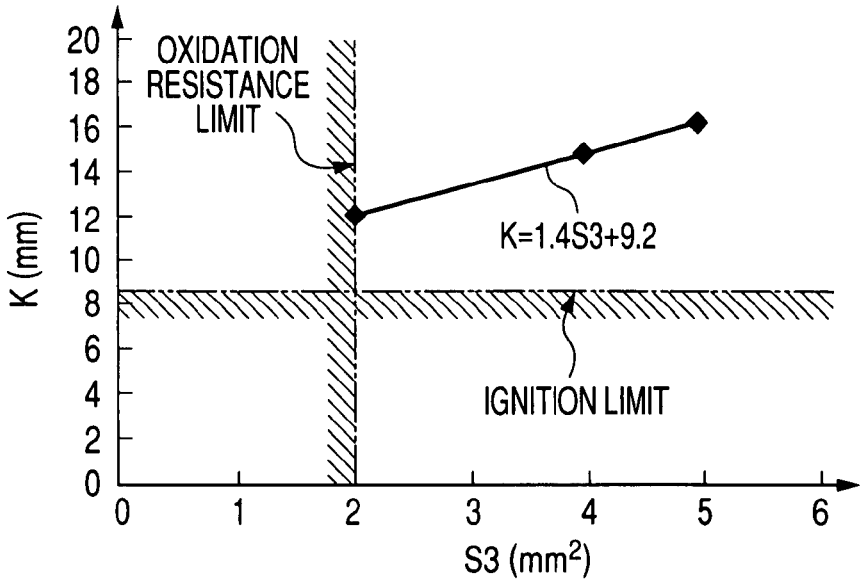
FIG. 14 is a graphic view showing a change of a ground electrode length at an oxidation resistance limit with respect to a sectional area of a ground electrode in the plug shown in FIG. 2.

FIG. 14 is a graphic view showing a change of the length K at the oxidation resistance limit (1050° C.) with respect to the sectional area S3 of the ground electrode 5. As shown in FIG. 14, a line satisfying the relation of K=1.4×S3+9.2 mm is drawn. When the ignition limit is considered, the area S3 equal to or larger than 2 $mm^2$ is preferably set to satisfy a relation of S3≦(K−9.2 mm)/1.4. Accordingly, the area S3 is preferably set to satisfy a relation of 2 $mm^2$≦S3≦(K−9.2 mm)/1.4.

Figure 15:
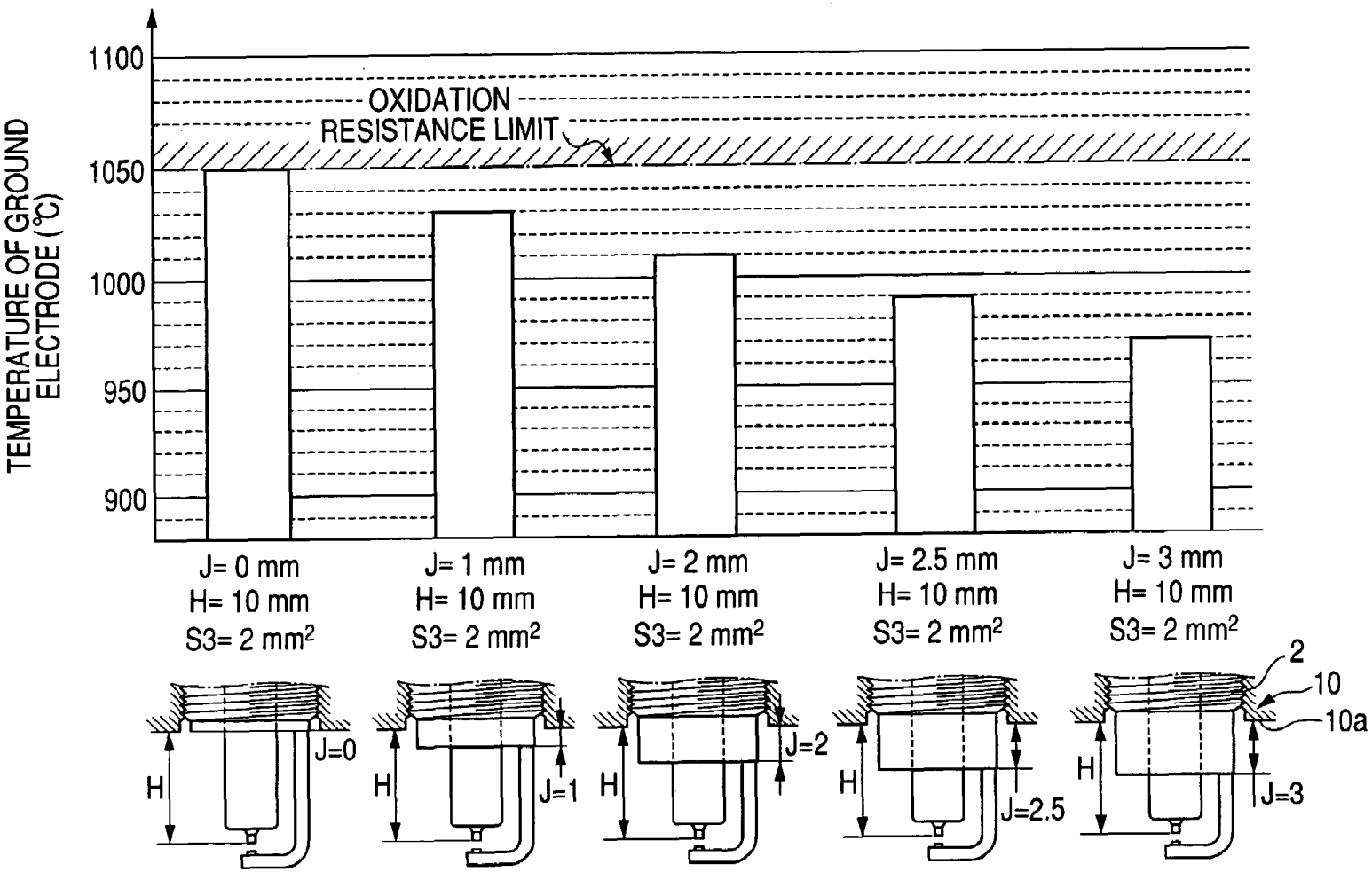
FIG. 15 is a graphic view showing a change in a temperature of a ground electrode with respect to a shroud length in the plug shown in FIG. 2.

A range of the shroud length J of the housing 2 is described with reference to FIG. 15 and FIG. 16. FIG. 15 is a graphic view showing a change in the temperature of the ground electrode 5 with respect to the shroud length J. Experimental results shown in FIG. 15 were obtained from samples of the plug 1, respectively, having the shroud length J of 0 mm, 1 mm, 2 mm, 2.5 mm and 3 mm at H=0 and S3=2 $mm^2$.

As shown in FIG. 15, as the shroud length J is increased, the length K of the ground electrode 5 is shortened. Therefore, the temperature of the electrode 5 is lowered as the shroud length J is increased. In case of the length J=0 mm, the temperature of the electrode 5 reaches the oxidation resistance limit (1050). In contrast, when the length J is equal to or larger than 1 mm, the shroud of the housing 2 causes the electrode 5 to efficiently release heat to the housing 2. Therefore, the length J is preferably set to be equal to or larger than 1 mm.

More preferably, the length J is set to be equal to or larger than 2.5 mm. In this case, the allowance from the oxidation resistance limit is increased. Further, because the electrode 5 is shortened, the electrode 5 is hardly broken.

Figure 16:
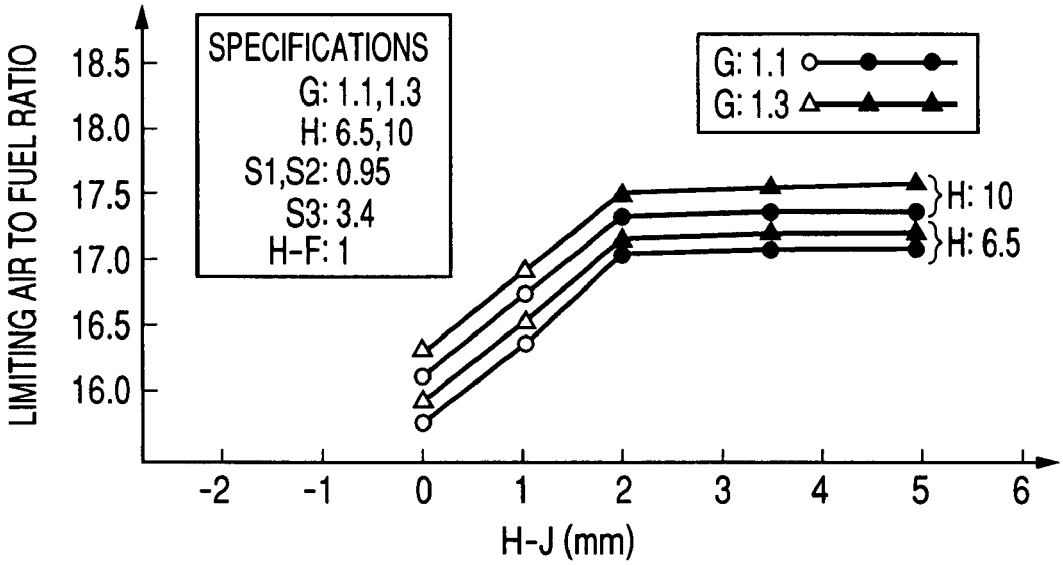
FIG. 16 is a graphic view showing a change in a limiting air to fuel ratio with respect to a difference H-J in the plug shown in FIG. 2.

An ignition performance of the plug 1 is estimated with reference to FIG. 16. FIG. 16 is a graphic view showing a change in a limiting air to fuel ratio with respect to a difference H-J between the lengths H and J. Experimental results shown in FIG. 16 were obtained by driving an engine with six cylinders and displacement of 2000 cc at an engine speed of 600 rpm in an idling operation. Samples of the plug 1 are adjusted together to have the areas S1=0.95 $mm^2$, S2=0.95 $mm^2$ and S3=3.4 $mm^2$, and a difference H−F=1 mm. Further, the samples are adjusted to have a combination of the lengths G=1.1 mm (most severe condition for ignition performance) and H=6.5 mm (minimum value), a combination of the lengths G=1.1 mm and H=10 mm (maximum value), a combination of the lengths G=1.3 mm and H=6.5 mm, and a combination of the lengths G=1.3 mm and H=10 mm, respectively.

As shown in FIG. 16, when the difference H-J is equal to or larger than 2 mm, the limiting air to fuel ratio becomes larger than 17.0. Therefore, to heighten an ignition performance in the plug 1, it is better that the difference H−J be equal to or larger than 2 mm.

Accordingly, when the oxidation resistance limit is considered, the length J and the spark position length H are preferably set to satisfy a relation of $$1\ \text{mm} \leqq J \leqq H-2\ \text{mm}.$$

More preferably, the length J and the spark position length H are set to satisfy a relation of $$2.5\ \text{mm} \leqq J \leqq H-2\ \text{mm}.$$

Assuming that the tip portion 5*a* of the ground electrode 5 is not protruded from the surface of the ground electrode 5, heat of flame kernels generated on the tip portion 5*a* is easily transferred to the ground electrode 5. Therefore, it is difficult that the flame kernels grows on the electrode 5 having a large heat capacity. However, in the plug 1, the tip portion 5*a* is protruded from the surface of the electrode 5 toward the tip portion 7*a* of the center electrode 7 to face the tip portion 7*a*. Accordingly, the flame kernels can reliably grow regardless of the heat capacity of the electrode 5, and the ignition performance of the plug 1 can be improved.

In other experimental results, it was found that the ignition performance of the plug 1 was considerably improved when the protrusion length U of the tip portion 5*a* was equal to or larger than 0.3 mm. Because of a heat spot limitation for the tip portion 5*a* to secure a resistance to the melting of the tip portion 5*a*, the length U equal to or smaller than 1.5 mm is preferred. Accordingly, the length U is preferably set within a range from 0.3 mm to 1.5 mm (0.3 mm≦U≦1.5 mm).

When the sectional area S2 of the tip portion 5*a* is smaller than 0.07 $mm^2$, the tip portion 5*a* is considerably heated up due to sparks so as to abnormally melt and lose a portion of the tip portion 5*a*. Therefore, a resistance to reduction of the tip portion 5*a* deteriorates. In contrast, when the sectional area S2 exceeds 0.95 $mm^2$, the heat capacity of the tip portion 5*a* is excessively enlarged. Therefore, flame kernels generated on the tip portion 5*a* for spark discharges are sometimes disappeared. That is, the ignition performance of the plug 1 is degraded. Accordingly, the sectional area S2 is preferably set within a range from 0.07 $mm^2$ to 0.95 $mm^2$ (0.07 $mm^2 \leqq S2 \leqq 0.95\ mm^2$). In other words, the diameter D5 of the tip portion 5*a* formed in a columnar shape is preferably set within a range from 0.3 mm to 1.1 mm (0.3 mm≦D5≦1.1 mm).

The tip portion 7*a* of the center electrode 7 is used as a negative electrode, so that the tip portion 7*a* reaches a temperature higher than the tip portion 5*a*. To prevent the tip portion 7*a* from being largely reduced by sparks discharged between the electrodes 5 and 7, the tip portion 7*a* is made of a material having a melting point equal to or higher than 2000° C. such as iridium or an iridium alloy containing 50% iridium or more by weight. In contrast, because the tip portion 5*a* of the ground electrode 5 is used as a positive electrode, the tip portion 5*a* is put in an atmosphere of oxidization at a high temperature. To prevent the tip portion 5*a* from being largely oxidized by a gas of the chamber 20, the tip portion 5*a* is made of platinum superior in resistance to oxidization or a platinum alloy containing 50% platinum or more by weight.

Figure 17:
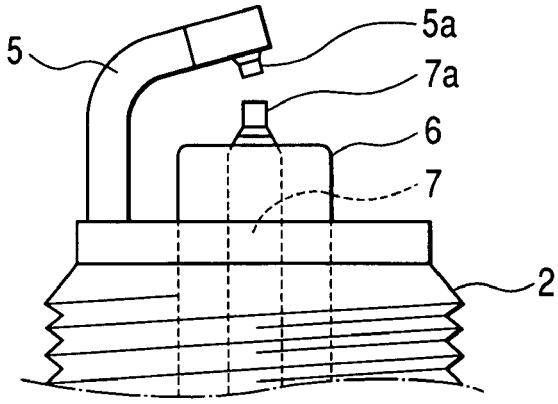
FIG. 17 is a front view of the ground electrode 5*a* according to a modification of this embodiment.

FIG. 17 is a front view of the ground electrode 5*a* according to a modification of this embodiment. As shown in FIG. 17, a top portion of the ground electrode 5*a* is extended at a slat to the center electrode 5*a*. More specifically, the ground electrode 5*a* extending from the housing 2 is bent toward the center electrode 5*a* by an angle smaller than 90 degrees, and the tip portion 5*a* reaches just over the tip portion 7*a*. Therefore, as compared with a case where the ground electrode 5*a* is bent by 90 degrees, the ground electrode 5*a* can be shortened.

With this structure of the electrode 5*a*, heat received in the electrode 5*a* due to sparks can be lessened, and the received heat can efficiently be transferred to the housing 2. Accordingly, the temperature of the electrode 5*a* can be lowered. Further, the electrode 5*a* having a lowered temperature can have a high resistance to oxidation.

As described above, the plug 1 is characterized by specific structures such as the length H set in a range of 6.5 mm≦H≦10 mm, the length G set in a range of 1.1 mm≦G≦2.0 mm, the lengths J, F and H set in a relation of J≦F≦H−1.0 mm, the sectional area S1 set in a range of 0.07 $mm^2 \leqq S1 \leqq 0.95\ mm^2$, the tip portion 5*a* made of platinum (Pt) or a platinum alloy containing 50% platinum or more by weight, the tip portion 7*a* made of iridium (Ir) or an iridium alloy containing 50% iridium or more by weight, and the clearance P, the length G and the areas S1 and S2 set in a relation of $P \leqq 1.1 \times (G + 0.0345 \times S1^{-1.2418} + 0.0327 \times S2^{-1.2418})$.

Accordingly, the plug 1 can have a high ignition performance due to the range 6.5 mm≦H, the range of 1.1 mm≦G, the relation J≦F≦H−1.0 mm, and the range of S1≦0.95 $mm^2$.

Further, the plug 1 can reliably prevent transverse flying sparks due to the range of G≦2.0 mm and the relation of $P \geqq 1.1 \times (G + 0.0345 \times S1^{-1.2418} + 0.0327 \times S2^{-1.2418})$ even when the plug 1 performs spark discharges for a long period of time.

Moreover, the plug 1 can reliably prevent oxidization and melting of the tip portions of the electrodes 5 and 6 due to the range of H≦10 mm, the sectional area S1 equal to or larger than 0.07 $mm^2$, the tip portion 5*a* made of platinum (Pt) or a platinum alloy, and the tip portion 7*a* made of iridium (Ir) or an iridium alloy.

The plug 1 is further characterized by specific structures such as the thickness T set at a range of 0.3 mm≦T≦11.0 mm, the diameter D3 set at a range of 1.9 mm≦D3≦2.8 mm, the leg length L set at a range of 10 mm≦L≦19 mm. Accordingly, the plug 1 can have a resistance to pre-ignition because of a range of 1.9 mm≦D3 and a range of L≦19 mm. Further, the plug 1 can have excellent resistance to smolder fouling because of a range of 10 mm≦L. Moreover, the plug 1 can secure the pocket clearance P because of a range of D3≦2.8 mm.

The plug 1 is further characterized by specific structures such as the diameter M of the male thread 3 of the housing 2 set within a range from 8 mm to 12 mm, the fitting length R set to be equal to or smaller than 25 mm, the diameter Z of the head portion 6*b* of the insulator 6 set to be equal to or larger than 7 mm, and the two-face width Q set to be equal to or smaller than 16 mm. Accordingly, transverse flying sparks can further be prevented due to the diameter M equal to or larger than 8 mm, a small-sized plug 1 having a high strength can be manufactured due to the diameter M equal to or smaller than 12 mm, the two-face width Q equal to or smaller than 16 mm and the diameter Z equal to or larger than 7 mm, and an angle between the valves 10*c* can be narrowed due to the fitting length R equal to or smaller than 25 mm.

The plug 1 is further characterized by specific structure of the length K and the sectional area S3 set in a relation of 2 mm≦S3≦(K−9.2 mm)/1.4. Accordingly, the plug 1 can reliably have a high ignition performance and a resistance to oxidization and erosion of the tip portion 5*a* of the ground electrode 5.

The plug 1 is further characterized by specific structure of the shroud length J set at a range of J≧1 mm. Accordingly, the plug 1 can reliably have a resistance to oxidization and erosion of the tip portion 5*a* of the ground electrode 5.

The plug 1 is further characterized by specific structure of the length J and H set at a relation of H-J 2 mm. Accordingly, the plug 1 can reliably have a high ignition performance.

The plug 1 is further characterized by specific structure of the ground electrode tip portion 5*a* which is protruded from the ground electrode 5 facing the center electrode 7 toward the tip portion 7*a* of the center electrode 7. Accordingly, flame kernels on the tip portion 5*a* can reliably grown, and the plug 1 can reliably have a high ignition performance.

The plug 1 is further characterized by specific structures such as the protrusion length U set in a range of 0.3 mm≦U≦1.5 mm and the sectional area S2 set in a range of 0.07 $mm^2$≦S2≦0.95 $mm^2$. Accordingly, the plug 1 can reliably have a high ignition performance due to 0.3 mm≦U and S2≦0.95 $mm^2$. Further, the plug 1 can reliably have a resistance to the melting of the tip portion 5*a* due to 0.07 $mm^2$≦S2 and U≦1.5 mm.

This embodiment should not be construed as limiting the present invention to the structure of this embodiment, and the structure of this invention may be combined with that based on the prior art.

What is claimed is:

1. A spark plug, comprising:

a center electrode;

an insulator disposed on an outer circumferential surface of the center electrode, the insulator having an end portion protruded from an end surface of a cylinder head of an internal combustion engine into a combustion chamber of the engine facing the end surface of the cylinder head;

a metallic housing disposed on an outer circumferential surface of the insulator and fixed to the cylinder head, the housing having an end portion facing the combustion chamber, a pocket bore being formed between the insulator and the housing so as to face the combustion chamber;

a ground electrode attached to the housing;

a tip portion disposed on the center electrode so as to be placed in the combustion chamber; and another tip portion disposed on the ground electrode to form a spark discharging gap between the tip portions, wherein a spark position length H between the end surface of the cylinder head and the tip portion of the center electrode is set within a range from 6.5 mm to 10 mm, a spark discharging gap length G between the tip portions is set within a range from 1.1 mm to 2.0 mm, a housing position length J between the end surface of the cylinder head and the end portion of the housing, the spark position length H and an insulator position length F between the end surface of the cylinder head and the end portion of the insulator are set to satisfy a relation of J≦F≦H−1.0 mm, a sectional area S1 of the tip portion of the center electrode on a plane perpendicular to a center axis of the center electrode is set within a range from 0.07 $mm^2$ to 0.95 $mm^2$, the tip portion of the center electrode is made of a first noble metal having a melting point equal to or higher than 2000° C. or is made of a first alloy containing the first noble metal, the tip portion of the ground electrode is made of a second noble metal having a melting point equal to or higher than 1700° C. or is made of a second alloy containing the second noble metal, and the spark discharging gap length G, the sectional area S1 of the tip portion of the center electrode, a sectional area S2 of the tip portion of the ground electrode on a plane perpendicular to a center axis of the ground electrode chip, and a pocket clearance P of the pocket bore denoting a half of a difference between an inner diameter of the end portion of the housing and an outer diameter of the end portion of the insulator are set to satisfy a relation of $$P \leqq 1.1 \times (G + 0.0345 \times S1^{-1.2418} + 0.0327 \times S2^{-1.2418})$$

when the areas S1 and S2 are expressed in $mm^2$ while the length G and the clearance P are expressed in mm.

2. The spark plug according to claim 1, wherein the spark discharging gap length G is set within a range from 1.3 mm to 2.0 mm.

3. The spark plug according to claim 1, wherein the end portion of the insulator has a thickness T set within a range from 0.3 mm to 1.0 mm, the center electrode has a diameter D3 set within a range from 1.9 mm to 2.8 mm, the pocket bore is closed at an contact line at which the housing and the insulator are attached to each other, and a leg length L between the contact line and the end portion of the insulator is set within a range from 10 mm to 19 mm.

4. The spark plug according to claim 1, further comprising:

a gasket attached to a second end surface of the cylinder head on a side opposite to the combustion chamber, wherein the housing has a male thread fitted to a female thread of the cylinder head, the male thread of the housing has a diameter M set within a range from 8 mm to 12 mm, a fitting length R between an end surface of the gasket facing the cylinder head and an end of the female thread of the cylinder head facing the combustion chamber is set to be equal to or smaller than 25 mm, the insulator has a head portion protruded from the cylinder head on the side opposite to the combustion chamber, a diameter of the head portion is set to be equal to or larger than 7 mm, the housing has a tool fitting portion with at least two faces on the side of the cylinder head opposite to the combustion chamber such that a fixing tool is fitted to two faces of the tool fitting portion to fix the housing to the cylinder head, and a width between the two faces of the tool fitting portion is set to be equal to or smaller than 16 mm.

5. The spark plug according to claim 1, wherein a ground electrode position length between the end surface of the cylinder head and an end surface of the ground electrode on a side opposite to the center electrode is expressed by K in mm, a sectional area of the ground electrode on a plane perpendicular to an extending direction of the ground electrode is expressed by S3 in $mm^2$, and the length K and the area S3 are set to satisfy a relation of 2 mm≦S3≦(K−9.2 mm)/1.4.

6. The spark plug according to claim 1, wherein the housing has a shroud protruded by 1 mm or more from the end surface of the cylinder head into the combustion chamber.

7. The spark plug according to claim 6, wherein the length J of the shroud and the spark position length H are expressed in mm and are set to satisfy a relation of 1 mm≦J≦H−2 mm.

8. The spark plug according to claim 6, wherein the length J of the shroud and the spark position length H are expressed in mm and are set to satisfy a relation of 2.5 mm≦J≦H−2 mm.

9. The spark plug according to claim 1, wherein the tip portion of the ground electrode is protruded from a surface of the ground electrode facing the center electrode toward the center electrode tip.

10. The spark plug according to claim 9, wherein a protrusion length of the tip portion of the ground electrode is set within a range from 0.3 mm to 1.5 mm, and the sectional area S2 of the tip portion of the ground electrode is set within a range from 0.07 $mm^2$ to 0.95 $mm^2$.

11. The spark plug according to claim 1, wherein the tip portion of the center electrode is made of an iridium alloy containing 50% iridium or more by weight, and the tip portion of the ground electrode is made of a platinum alloy containing 50% platinum or more by weight.

12. A spark plug, comprising:

a center electrode;

an insulator disposed on an outer circumferential surface of the center electrode, the insulator having an end portion protruded from an end surface of a cylinder head of an internal combustion engine into a combustion chamber of the engine facing the end surface of the cylinder head;

a metallic housing disposed on an outer circumferential surface of the insulator and fixed to the cylinder head, the housing having an end portion facing the combustion chamber;

a ground electrode attached to the housing;

a tip portion disposed on the center electrode so as to be placed in the combustion chamber; and another tip portion disposed on the ground electrode to form a spark discharging gap between the tip portions, wherein a spark position length H between the end surface of the cylinder head and the tip portion of the center electrode is set to be equal to or smaller than 6.5 mm, a spark discharging gap length G between the tip portions is set to be equal to or larger than 1.1 mm, a housing position length J between the end surface of the cylinder head and the end portion of the housing, the spark position length H and an insulator position length F between the end surface of the cylinder head and the end portion of the insulator are set to satisfy a relation of J≦F≦H−1.0 mm, and a sectional area of the tip portion of the center electrode on a plane perpendicular to a center axis of the center electrode is set to be equal to or smaller than 0.95 $mm^2$.

13. The spark plug according to claim 12, wherein a sectional area of the tip portion of the ground electrode on a plane perpendicular to a center axis of the ground electrode is set to be equal to or smaller than 0.95 $mm^2$ and a protrusion length of the tip portion of the ground electrode is set to be equal to or smaller than 0.3 mm.

14. The spark plug according to claim 12, wherein the housing has a shroud protruded from the end surface of the cylinder head into the combustion chamber, and a protrusion length J of the shroud and the spark position length H are set to satisfy a relation of J≦H−2 mm.

15. A spark plug, comprising:

a center electrode;

an insulator disposed on an outer circumferential surface of the center electrode, the insulator having an end portion protruded from an end surface of a cylinder head of an internal combustion engine into a combustion chamber of the engine facing the end surface of the cylinder head;

a metallic housing disposed on an outer circumferential surface of the insulator and fixed to the cylinder head, the housing having an end portion facing the combustion chamber, a pocket bore being formed between the insulator and the housing so as to face the combustion chamber;

a ground electrode attached to the housing;

a tip portion disposed on the center electrode so as to be placed in the combustion chamber; and another tip portion disposed on the ground electrode to form a spark discharging gap between the tip portions, wherein a spark discharging gap length G between the tip portions is set to be equal to or smaller than 2.0 mm, a sectional area S1 of the tip portion of the center electrode on a plane perpendicular to a center axis of the center electrode is set to be equal to or larger than 0.07 $mm^2$, and the length G, the areas S1 and S2 and a pocket clearance P of the pocket bore denoting a half of a difference between an inner diameter of the end portion of the housing and an outer diameter of the end portion of the insulator are set to satisfy a relation of $$P \geqq 1.1 \times (G + 0.0345 \times S1^{-1.2418} + 0.0327 \times S2^{-1.2418})$$

when the areas S1 and S2 are expressed in $mm^2$ while the length G and the clearance P are expressed in mm.

16. The spark plug according to claim 15, wherein a sectional area S2 of the tip portion of the ground electrode on a plane perpendicular to a center axis of the ground electrode is set to be equal to or larger than 0.07 $mm^2$.

17. The spark plug according to claim 15, wherein a spark position length between the end surface of the cylinder head and the tip portion of the center electrode is set to be equal to or smaller than 10 mm.

18. The spark plug according to claim 15, wherein the tip portion of the center electrode is made of a first noble metal having a melting point equal to or higher than 2000° C. or is made of a first alloy containing the first noble metal, and the tip portion of the ground electrode is made of a second noble metal having a melting point equal to or higher than 1700° C. or is made of a second alloy containing the second noble metal.

19. The spark plug according to claim 15, wherein the housing has a male thread fitted to a female thread of the cylinder head, and the male thread of the housing has a diameter set to be equal to or larger than 8 mm.

* * * * *

UNITED STATES PATENT AND TRADEMARK OFFICE

CERTIFICATE OF CORRECTION

PATENT NO. : 7,652,413 B2
APPLICATION NO. : 11/907447
DATED : January 26, 2010
INVENTOR(S) : Kawashima It is certified that error appears in the above-identified patent and that said Letters Patent is hereby corrected as shown below:

In Column 16, line 33, "$P \leqq 1.1 \times (G+0.0345 \times S1^{-1.2418}+0.0327 \times S2^{-1.2418})$" should be --$P \geqq 1.1 \times (G+0.0345 \times S1^{-1.2418}+0.0327 \times S2^{-1.2418})$--

Signed and Sealed this

Thirteenth Day of April, 2010

David J. Kappos

David J. Kappos
*Director of the United States Patent and Trademark Office*